US008626039B2

(12) United States Patent
Aoki et al.

(10) Patent No.: US 8,626,039 B2
(45) Date of Patent: Jan. 7, 2014

(54) IMAGE FORMING APPARATUS AND METHOD CAPABLE OF OBTAINING HIGH QUALITY IMAGE SUPPRESSING EDGE EFFECT

(75) Inventors: Katsuhiro Aoki, Kanagawa (JP); Akira Azami, Kanagawa (JP); Daichi Yamaguchi, Kanagawa (JP); Akihiro Kawakami, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 160 days.

(21) Appl. No.: 13/248,418

(22) Filed: Sep. 29, 2011

(65) Prior Publication Data

US 2012/0082485 A1 Apr. 5, 2012

(30) Foreign Application Priority Data

Oct. 5, 2010 (JP) ..... 2010-226032
Apr. 11, 2011 (JP) ..... 2011-087054
Jun. 3, 2011 (JP) ..... 2011-124914

(51) Int. Cl.
*G03G 15/09* (2006.01)

(52) U.S. Cl.
USPC ..... 399/270; 399/55; 399/276

(58) Field of Classification Search
USPC ..... 399/27, 55, 267, 270, 272
See application file for complete search history.

(56) References Cited

U.S. PATENT DOCUMENTS

| | | | | |
|---|---|---|---|---|
| 6,282,391 | B1 * | 8/2001 | Takeda | 399/175 |
| 6,674,985 | B2 | 1/2004 | Azami | |
| 6,895,203 | B2 | 5/2005 | Ozeki et al. | |
| 6,904,244 | B2 | 6/2005 | Azami et al. | |
| 7,283,774 | B2 | 10/2007 | Ozeki et al. | |
| 7,457,571 | B2 | 11/2008 | Azami | |
| 7,480,475 | B2 | 1/2009 | Miyoshi et al. | |

FOREIGN PATENT DOCUMENTS

| | | |
|---|---|---|
| JP | 10-239914 | 9/1998 |
| JP | 2003-263033 | 9/2003 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

A developing device includes a non-magnetic rotatable sleeve of a developer bearer to bear developer and a development electric field generator to generate a development electric field between the image bearer and the developer bearer by applying a development bias to the developer bearer. The developing bias is an AC bias generating an AC electric field therebetween. The magnetic carrier includes a plurality of fine particles each covered by a covering layer made of prescribed material having a volume resistivity equal to or more than $10^{12}$ [Ω·cm] having a prescribed particle diameter equal to or less than 100 [nm]. Each of the a plurality of fine particles has a total volume resistivity equal to or less than $10^{5}$ [Ω·cm]. The magnetic carrier has a total volume resistivity equal to or more than $10^{12}$ [Ω·cm].

12 Claims, 6 Drawing Sheets

IMAGE FORMING APPARATUS AND METHOD CAPABLE OF OBTAINING HIGH QUALITY IMAGE SUPPRESSING EDGE EFFECT

CROSS-REFERENCE TO RELATED APPLICATIONS

This patent application is based on and claims priority pursuant to 35 U.S.C. §119 to Japanese Patent Application Nos. 2010-226032, 2011-087054, and 2011-124914, filed on Oct. 5, 2010, and Apr. 11 and Jun. 3, 2011, respectively, the entire disclosure of which is hereby incorporated herein by reference.

FIELD OF THE INVENTION

The present invention relates to an image forming apparatus, such as a printer, a facsimile, a copier, etc., and an image formation method implemented using the image forming apparatus.

BACKGROUND OF THE INVENTION

In an image forming apparatus, a magnetic brush type developing device is generally employed to develop a latent image formed on a photoconductor serving as an image bearer with two-component developer composed of toner and magnetic carrier, as described, for example, in Japanese Patent Application Laid Open No. 10-239914 (JP-H10-239914-A). In such a developing device, a hollow cylindrical developing drum that accommodates multiple magnetic poles is generally employed and is freely rotated in the image forming apparatus. The developing drum carries and conveys the developer to a developing region, in which the photoconductor bearing a latent image is opposed thereto, and develops the latent image with the toner.

In such a developing process, a phenomenon called an edge effect frequently occurs. Specifically, excess toner is attracted to a thin line, a dot having a small diameter, or an outline of a solid image or the like. Consequently, an image is rarely uniformly formed, because the thin line and the dot of small diameter are fattened, and accordingly a latent image is not highly precisely reproduced on the photoconductor.

It is known that such an edge effect can be suppressed when a resistance of the magnetic carrier is decreased and a dielectric constant thereof is increased. Further, use of a low-resistance magnetic carrier decreases electric resistance of the total developer while increasing intensity of a development electric field, thus developing performance can be improved at the same time.

In general, magnetic carrier is borne on a developing drum by a magnetic force. However, the magnetic carrier acquires an electric charge after an electrostatic induction or electric charge injection process, so that an electrostatic force is generated between the electric charge of the magnetic carrier and that on a photoconductor. In such a situation, the smaller the electric resistance of the magnetic carrier, the stronger the electrostatic force due to the electrostatic induction or electric charge injection. For this reason, when the electric resistance of the magnetic carrier is excessively low, the electrostatic force arising between the magnetic carrier and the photoconductor exceeds the magnetic force arising between the magnetic carrier and the developing drum, so that the magnetic carrier becomes readily attracted to the photoconductor.

BRIEF SUMMARY OF THE INVENTION

Accordingly, an object of the present invention is to provide a novel image forming apparatus that comprises an image bearer to bear a latent image on its surface, a developer container to accommodate developer composed of toner and magnetic carrier, and a developing device. The developing device includes a non-magnetic rotatable sleeve as a developer bearer to bear the developer on its surface, and a development electric field generator to generate a development electric field between the image bearer and the developer bearer by applying a development bias to the developer bearer. The developing device visualizes the latent image borne on the image bearer as a toner image with the toner of the developer in the development electric field. The developing bias is an alternating current (hereinafter simply referred to as an AC) bias that generates an AC electric field therebetween. The magnetic carrier includes a plurality of fine particles each covered by a covering layer made of prescribed material having a volume resistivity equal to or more than $10^{12}$ [Ω·cm] and having a prescribed particle diameter equal to or less than 100 [nm]. Each of the a plurality of fine particles has a total volume resistivity equal to or less than $10^{5}$ [Ω·cm]. The magnetic carrier has a total volume resistivity equal to or more than $10^{12}$ [Ω·cm]

In another aspect of the present invention, the magnetic fine particles are dispersed in resin to produce the magnetic carrier.

In yet another aspect, a direction of the AC electric field is alternated more than a prescribed number of times during a development process by changing a frequency of the AC bias in accordance with a line speed of the image bearer.

In yet another aspect, a below-described relation is met, $$f \geqq 63 \times vP/N,$$

wherein "f" represents a frequency [kHz] of an AC bias, vP represents a line speed [mm/s] of an image bearer, and "N" represents a width [mm] of a developing nip in an image bearer rotating direction formed between the image bearer and the developer bearer.

In yet another aspect, a developing gap creator is provided to create a developing gap between the image bearer and the developer bearer, and a gap changer to change a size of the gap in a prescribed cycle.

In yet another aspect, the total resistivity of the magnetic carrier is equal to or more than $10^{14}$ [Ω·cm].

BRIEF DESCRIPTION OF THE SEVERAL VIEWS OF THE DRAWINGS

A complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
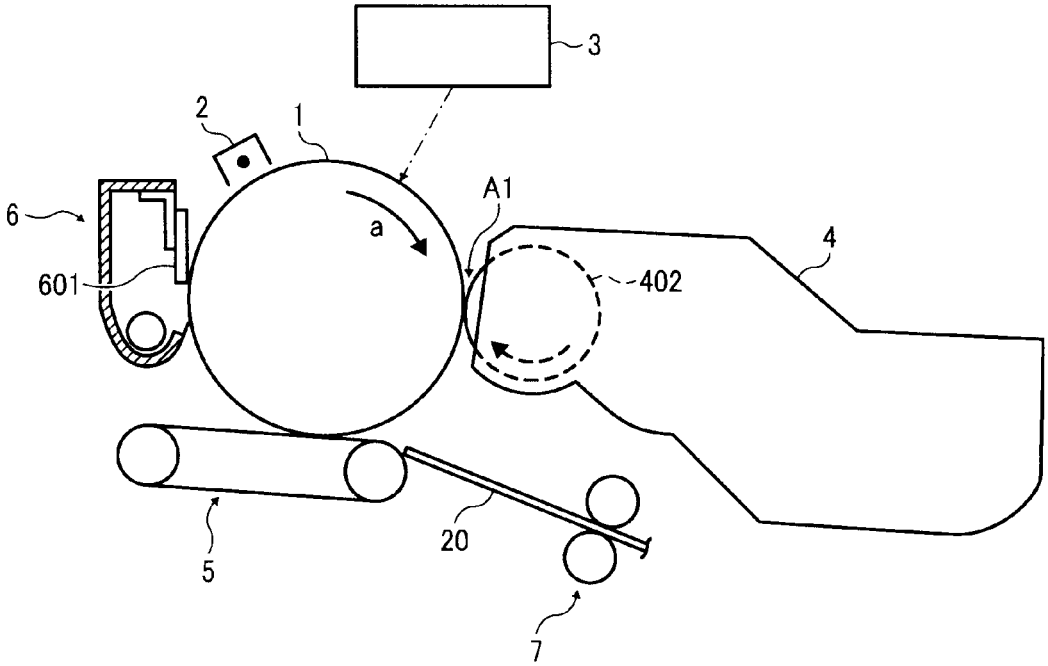
FIG. 1 schematically illustrates an exemplary configuration of main elements of a printer according to one embodiment of the present invention.

Referring now to the drawings, wherein like reference numerals designate identical or corresponding parts throughout several views, in particular in FIG. 1, the configuration of an electrophotographic laser printer (herein after simply referred to as a printer) as an image forming apparatus according to one embodiment of the present embodiment is described.

As shown, the printer includes a drum state photoconductor 1 to serve as an image bearer. The printer further includes a charger 2 to uniformly charge the surface of the photoconductor 1, an exposure device 3 to emit a laser light beam and similar modulated in accordance with image information, and a developing device 4 to form a toner image by adhering toner charged and borne on a developing roller 402 to a latent image formed on the photoconductor 1. Each of devices is disposed around the drum 1 in this order. Also subsequently disposed around the photoconductor 1 are a transfer device 5 to transfer the toner image on the photoconductor 1 onto a transfer sheet 20 and a cleaner 6 and similar to remove residual toner remaining on the photoconductor 1 after a transfer process. Thus, the charger 2 and the exposure device 3 collectively constitute a latent image formation device.

Further, a sheet conveyer, not shown, is provided to feed and convey a sheet from a sheet tray and similar, not shown. A fuser is also provided to fuse a toner image transferred by the transfer device 5 onto the sheet 20.

Multiple parts of the printer can be constituted as a single unit detachably installed in the printer. For example, the photoconductor 1, the charger 2, the developing device 4, and the cleaner 6 can collectively constitute an image formation process unit detachably installed in the printer.

In the printer with the above-described configuration, the surface of the photoconductor 1 rotating in a direction shown by an arrow "a" is uniformly charged by the charger 2. The photoconductor 1 is scanned by the laser light beam modulated in an axial direction of the photoconductor 1 in accordance with image information to form a latent image on the photoconductor 1. The developing device 4 adheres toner to the latent image on the photoconductor 1 in a developing region A1, so that the latent image becomes a toner image.

Further, the transfer sheet 20 is fed and conveyed by a sheet conveyer, not shown, and is launched by a registration roller 7 into a transfer section, in which the photoconductor 1 is opposed to the transfer device 5, at a prescribed time. Then, by providing an electric charge having an opposite polarity to that of the toner image borne on the photoconductor 1 to the transfer sheet 20 via the transfer device 5, the toner image thereon is transferred onto the transfer sheet 20.

Subsequently, the transfer sheet 20 is separated from the photoconductor 1, and is conveyed to the fixing device, not shown. The toner image is then fused onto the transfer sheet 20 and the transfer sheet 20 is discharged from the apparatus.

The surface of the photoconductor 1 is cleaned by a cleaning blade 601 provided in the cleaner 6, so that the toner remaining thereon is removed.

Figure 2:
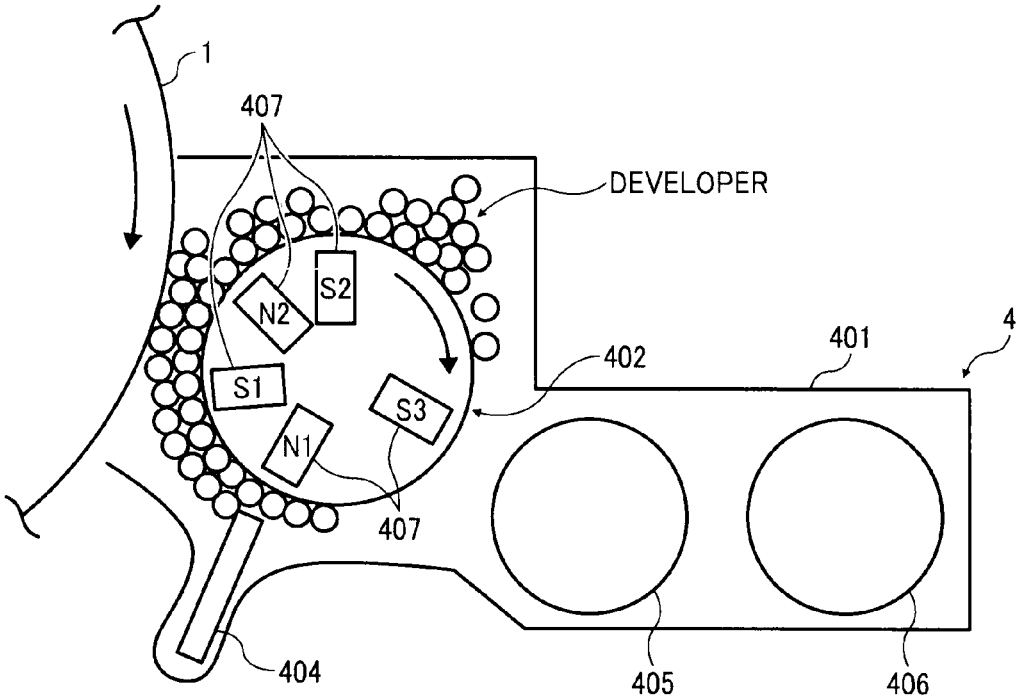
FIG. 2 schematically illustrates an exemplary configuration of surrounding elements of the printer of FIG. 1.

Now, a first embodiment is described with reference to FIG. 2. The developing device 4 provided in the printer employs a two-component developing system in that toner and carrier is accommodated in a casing 401 serving as a developer container. A developing roller 402 bears developer and applies a development process to the photoconductor 1. A rotation shaft of the developing roller 402 is rotatably supported by a bearing provided on a supporting section of the casing 401 so that the developing roller 402 is rotated clockwise by a driver, not shown.

A developing gap as a shortest distance between the surface of the photoconductor 1 and that of the developing roller in the developing region A1 is 300 [μm], which is adjusted in accordance with a developing condition.

A power source, not shown, applies a voltage of an AC bias to the developing roller 402 as a developing bias. Consequently, an AC electric field, a direction of which is periodically changed, is generated between the developing roller 402 and the photoconductor 1 as a development electric field due to a difference in voltage between the latent image and the developing bias. Accordingly, when the toner on the developing roller 402 adheres to the latent image on the photoconductor 1 in the development electric field, the latent image is developed and is visualized.

The developing roller 402 is a hollow cylindrical sleeve made of non-magnetic stainless having a diameter of about 18 [mm] and accommodates five magnets 407. Each of the magnets 407 is secured in the developing roller 402 not to rotate therein. The magnet 407 provides a magnetic force to developer passing through a prescribed section on the developing roller 402 opposed to the magnets 407.

A surface layer of the developing roller 402 is roughened by sandblasting or a similar manner to favorably have a surface roughness Rz (average of 10 points) of from about 10 [μm] to about 30 [μm]. Specifically, if the surface is more roughened up, a bearing amount of carrier extraordinarily increases and developer drops or the other problem occurs.

By contrast, if the surface roughness Rz is less than 10 [μm], the developer cannot precisely be conveyed, and accordingly insufficiently borne thereon. Consequently, a developing performance deteriorates and a desired image density cannot be obtained due to shortage of a developer-lifting amount. The above described roughening manner is not limited to the sand blast, and a surface of the developing roller 402 can have a prescribed groove or attracts prescribed particles thereon.

The magnets 407 installed in the developing roller 402 includes five magnetic poles of from N(N1), S(S1), N(N2), S(S2), and S(S3) in this order arranged from a smoothing blade 404 in a rotational direction of the developing roller 402. The arrangement of the magnetic poles of the magnets 407 is not limited to that of FIG. 2, and another arrangement can be employed considering an arrangement of the smoothing blade 404 around the developing roller 402.

A brush composed of the developer having the toner and the magnetic carrier are borne on the developing roller 402 by a magnetic force of the magnets 407. Toner in the magnetic brush on the magnetic roller 402 is mixed with the magnetic carrier and acquires a prescribed charge amount. Although developer other than that on the developing roller 402 in the developing device 4 of FIG. 2 is omitted, such developer is stirred by rotational forces of stirring and conveying members 405 and 406 and the developing roller 402 as well as a magnetic force of the magnets 407 provided in the casing 401.

Accordingly, a prescribed electric charge is provided to the toner due to friction charge caused by magnetic carrier having a relatively small particle diameter. A charge amount of the toner on the developing roller 402 preferably ranges from about −10 [μC/g] to about −40 [μC/g].

Further, the gap created at a nearest section between the smoothing blade 404 and the developing roller 402 is about 300 [μm]. The magnetic pole N1 of the magnets 407 opposed to the smoothing blade 404 is inclined upstream of the developing roller 402 therefrom by a few degree of the angle in the rotation direction thereof. Thus, a circulation current of the developer can be readily generated in the casing 401.

The smoothing blade 404 contacts the magnetic brush formed on the developing roller 402 at a section opposed to the developing roller 402 and determines an amount of the developer to be borne and conveyed thereon.

Hence, the developer is borne and conveyed by the magnets 407 of the developing roller 402 around the developing roller 402 and is used for development. In this embodiment, since a rotational direction of the photoconductor 1 is different from that of the developing roller 402, the development is executed with a relatively large difference in line speed. Further, since a direction of the electric field changed as time elapses due to application of the AC bias between the photoconductor 1 and the developing roller 402, the toner makes movement including reciprocation from the developer and completes the development.

As described above, the developing gap of the nearest distance between the photoconductor 1 and the developing roller 402 in the developing region A1 is about 300 [μm]. Accordingly, an area of the developing region A1 is calculated by multiplying about 330 [mm] (i.e., width) by about 5 [mm] (i.e., length) by regarding about 320 [mm] as a valid width. Further, as described above, the AC development electric field is formed between the photoconductor 1 and the developing roller 402 in the developing region A1.

Specifically, a DC voltage equivalent to a prescribed developing bias and an AC bias having a peak-to-peak voltage of from about 0.1 [kV] to about 0.8 [kV] are applied to the developing roller 402. A waveform is favorably rectangular and is generated at a frequency of from about 3 [kHz] to about 12 [kHz]. A duty ratio is favorably from about 20[%] to about 45[%]. The above-described conditions can appropriately be adjusted in accordance with performances of toner and a developing roller 402 or the like.

Since the toner has electric charge, the toner reciprocates between the photoconductor 1 and the developing roller 402 in accordance with a direction of the electric field when the AC electric field is formed therebetween and is the direction is changed as time elapses, so that the toner can readily separate from the developing roller 402. Hence, the separated toner then contacts and is collected by developer being conveyed by the developing roller 402 to be reused in the subsequently developing operations.

Since the toner is sufficiently charged in the developer, the toner adheres to the carrier therein so that coverage thereof greatly increases. The developer borne on the developing roller 402 is then conveyed into the developing region A1 maintaining the above-described condition as the developing roller 402 rotates. Subsequently, the toner selectively adheres to a latent image on the photoconductor 1 in the development electric field formed in the developing region A1.

Now, an exemplary operation of the above-described developing device 4 is described. Some of developer composed of mixture of toner and carrier is stored in the casing 401 of the developing device 4. The developer is stirred by rotation and magnetic forces of the stirring and conveying devices 405 and 406 and the developing roller 402 as well as the magnets 407. Consequently, the toner is provided with electric charge by a friction caused between the toner and the carrier.

The developer borne on the developing roller 402 is smoothed by the developing blade 404 so that an amount thereof is determined. Subsequently, the developer borne on the developing roller 402 is conveyed by rotation of the developing roller 402 to the developing region A1, and selectively adheres and visualizes a latent image on the photoconductor 1 in the development electric field generated by the developing bias. In this printer, a toner attraction amount is about 0.4 [mg/cm$^2$] and an average amount of charge is about −31 [μC/g] on a solid toner image section.

The toner, an average particle diameter of which is from about 4 [μm] to about 8 [μm], is advantageously used in this developing system to obtain a high quality image. Specifically, when a weight average particle diameter of the toner is less than 3 [μm] and is used for a long time, the apparatus is contaminated due to scattering of the toner and image density deteriorates in a low humidity environment. Further, cleanability of the photoconductor 1 deteriorates at the same time. By contrast, when a weight average particle diameter of the toner is greater than 8 [μm], resolution of a fine spot less than 8 [μm] deteriorates, and an image is degraded when the toner scatters to a non-image section, or similar phenomenon occurs.

Now, toner used in this embodiment is described more in detail. Specific examples of the resins included in toner include polystyrene resin, epoxy resin, and polyester resin. Specific examples of the resins further include polyamide resin, styrene acrylic resin, and styrene methacrylate resin. Specific examples of the resins further include vinyl resin, polyurethane resin, and polyolefin resin. Specific examples of the resins also include styrene-butadiene resin, phenol resin, and polyethylene resin. Specific examples of the resins further include silicon resin, butyral resin, terpene resin, and polyol resin. Specific examples of the vinyl resin include styrene, such as polystyrene, polyvinyl toluene, etc., monopolymer of these derivative substitutions, and styrene copolymer. Also included are hacrylate, polybutyl methacrylate, polyvinyl chloride, and polyvinyl acetate. Specific examples of styrene copolymer include styrene-p-chloro styrene copolymer, styrene-propylene copolymer, and styrene-vinyl toluene copolymer.

Further included in the specific examples of styrene copolymer are styrene-vinyl naphthalene copolymer, styrene-acrylic acid methyl copolymer, and styrene-acrylic acid ethyl copolymer. Yet further included in the specific examples of the styrene copolymer are styrene-acrylic acid butyl copolymer, styrene-acrylic acid octyl copolymer, and styrene-methacrylic acid methyl copolymer. Yet further included in the specific examples of the styrene copolymer are styrene-methacrylic acid ethyl copolymer, and styrene-methacrylic acid butyl copolymer. Further included in the specific examples of the styrene copolymer are styrene-p-chloro styrene copolymer, styrene-acrylic nitrile copolymer, and styrene-vinyl methyl ether copolymer. Further included in the specific examples of the styrene copolymer are styrene-vinyl ethyl ether copolymer, styrene-vinyl methyl ketone copolymer, and styrene-butadiene copolymer. Specific examples of the vinyl resin include styrene, such as polystyrene, polyvinyl toluene, etc., and monopolymer of these derivative substitutions.

Polyester resin may be added as a third component. Specific examples of the polyester resins include divalent alcohol, dibasic acid salt, and trivalent or more alcohol as described below in from groups A to C.

The group A includes ethylene glycol, triethlene glycol, and 1,2-propylene glycol. Further included in the group A are 1,3-propylene glycol, 1,4 butanediol, and neopentylglycol. Further included are 1,4 butanediol, 1,4-bis (hydroxymethyl) cyclohexane, and bisphenol A. Yet further included are hydrogenized bisphenol A, polyoxyethylene bisphenol A, and polyoxypropylene (2,2)-2,2'-bis(4-hydroxyphenyl) propane. Further included are polyoxypropylene (3,3)-2,2'-bis(4-hydroxyphenyl) propane, and polyoxypropylene (2,0)-2,2'-bis (4-hydroxyphenyl) propane.

The group B includes maleic acid, fumaric acid, and mesaconic acid. Further included in the group B are citraconic acid, itaconic acid, and glutaconic acid. Further included in the group B are phthalic acid, isophthalic acid, and terephthalic acid. Yet further included in the group B are cyclohexanedicarboxylic acid, succinic acid, and adipic acid. Yet further included in the group B are sebacic acid, malonic acid, and linolenic acid. Specific examples of the group B further include acid anhydride of those and lower alcohol or ester.

Specific examples of the group C includes glycerin, trimethylolpropane, and trimethylolpropane. Further included in the group C are pentaerythritol, more than trivalent alcohol, and trimellitic acid. Yet further included in the group C are pyromellitic acid and more than trivalent carboxylic acid. Specific examples of the polyol resin include appendix of epoxy resin and alkylene oxide of divalent phenol, and chemistry of glycidyl ether of those material and chemical compound having one active hydrogen and that having a plurality of active hydrogens in a molecule, which reacts to epoxy group.

Further, pigments described below are employed in toner of the various embodiments. Specific examples of the black pigments include carbon black, Nigrosine dyes, and black iron oxide.

Specific examples of the yellow pigments include NAPHTHOL YELLOW S, HANSA YELLOW 10G, HANSA YELLOW 5G, HANSA YELLOW G, Cadmium Yellow, yellow iron oxide, loess, chrome yellow, Titan Yellow, Polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE Yellow GR, Permanent Yellow NCG, VULCAN FAST Yellow 5G, VULCAN FAST Yellow R, Tartrazine Lake, Quinoline Yellow LAKE, ANTHRAZANE Yellow BGL and isoindolinone yellow.

Specific examples of the orange pigments include, Benzidine Orange, Perynone orange, and Oil Orange.

Specific examples of the red pigments include red iron oxide, red lead, orange lead, cadmium red, cadmium mercury red, antimony orange, Permanent Red 4R, Para Red, Fire Red, P-chloro-o-nitroaniline red, Lithol Fast Scarlet G, Brilliant Fast Scarlet, Brilliant Carmine BS, Permanent RED F2R, Permanent RED F4R, Permanent RED FRL, Permanent RED FRLL, Permanent RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, Permanent BORDEAUX F2K, HELIO BORDEAUX BL, Bordeaux 10B, BONMAROON LIGHT, BONMAROONMEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, Polyazo red, and Chrome Vermilion are included.

Specific examples of the violet pigments include Fast Violet B, Methyl Violet Lake, cobalt violet, manganese violet, dioxane violet, and Anthraquinone Violet.

Specific examples of the blue pigments include cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, and Anthraquinone Blue.

Specific examples of the green pigments include Chrome Green, zinc green, chromium oxide, viridian, emerald green, Pigment Green B, NaPhthol Green B, Green Gold, Acid Green Lake, Malachite Green Lake, Phthalocyanine Green, Anthraquinone Green, titanium oxide, zinc oxide, and lithoPone and the like.

These materials are used alone or in combination. Especially, in color toner, pigment needs to be favorably uniformly dispersed. For this reason, the pigment is not directly put in a large amount of resin, and accordingly a master batch is once produced dispersing pigments with high density, and is then thinned and put thereinto. In such a situation, solvent is generally used to promote dispersion thereof, and thereby raising a problem of environment or the like. Then, such dispersion is executed using water in this embodiment. However, in such a situation, temperature control is necessitated to resolve a problem caused by residual water in the master batch.

An electric charge controlling agent is blended (internally added to) in a toner particle of one embodiment. With such an electric charge controlling agent, an electric charge amount is controlled to have an optimum level in accordance with a developing system. Specifically, a granularity distribution and an electric charge amount are better balanced and the balance is further stabled in this embodiment. Specific examples of the charge controlling agents for providing a positive electric charge to toner include Nigrosine, Quaternary ammonium compounds, and triphenylmethane dye. Specific examples of the charge controlling agents for providing a positive electric charge further include imidazole metal-complex, and salt. These materials can be used alone or in combination. Specific examples of the charge controlling agents for providing a negative electric charge to toner include salicylic acid metal-complex, salt, organic boron salt, and calixarene compound.

Further, to avoid toner offsetting during toner fixation, a release agent is internally added to the toner in this embodiment. Suitable release agent agents include natural waxes, such as candelilla Wax, etc., and montan wax, low molecular weight Polyethylene waxes, polypropylene waxes, etc. These waxes can be used alone or in combination. A melting point of these release agents is preferably from about 65 degree centigrade to about 90 degree centigrade. Specifically, when the melting point is higher than the range, offsetting highly likely occurs in a region in which temperature of a fixing roller is low, and when lower, blocking highly likely occurs during toner preservation.

To improve dispersion of the release agent or the like, additives can be additional included. Specific examples of the additives include styrene acrylic resin and Polyethylene resin or the like.

Crystal polyester can also be employed as resin. Because, crystal polyester belongs to fatty acid polyester having a crystal performance with a sharp distribution of a molecular weight, in which an absolute value of a low molecular weight part is increased as much as possible. The resin causes crystal transition at a glass transition temperature (Tg), and melting viscosity sharply drops from a solid state and exerts a fixing performance onto a sheet at the same time. With usage of the crystal polyester resin, low temperature fixation can be achieved without excessively decreasing the Tg and the molecular weight of the resin. For this reason, preservation performance is not degraded even though the Tg decreases, while avoiding excessive glossiness in accordance with a tendency of low molecular weight or anti offsetting performance. Accordingly, the crystal polyester resin is also extraordinarily advantageous for improving low temperature fixation performance.

An average roundness level of toner particle is measured using a flow type particle image analysis system of FPIA-1000 (Manufactured by Sysmex Corporation).

Further, inorganic fine powder having an average particle diameter of from about 10 [nm] to about 200 [nm] is preferably attracted or fixed to a surface of toner as a fluidity promoting agent as described above. When the particle diameter is less than 10 [nm], an uneven surface effective to the fluidity is hardly produced, and when it is greater than 200 [nm], a shape of the powder becomes rough and causes a problem of a bad toner shape.

Specific examples of the inorganic fine particles in this embodiment include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc., but are not limited thereto. These materials can be used alone or in combination. Among those, fine particles of silica, titania, and alumina are preferably used. It is effective if the powder is subjected to a surface quality improvement process using hydrophobic processing agents.

Specific examples of the hydrophobizing agents typically include dimethyl-dichlor-silane, trimethylchlorcilan, and methyltrichlorosilane. The specific examples of the hydrophobizing agents further include allyldichloromethylsilane, allyldichlorophenylsilane, and benzyldimethylchlorosilane. Further included in the specific examples are bromomethylchlorodimethylsilane, α-chlorotrichloroethylsilane, and p-chlorotrichloroethylsilane. Yet further included in the specific examples are Chloromethyldimethylchlorosilane. Chloromethyltrichlorosilane, hexaphenyldisilane Hexatolyldisiloxane or the like.

From about 0.1 weight % to about 2 weight % of inorganic fine powder in relation to toner is preferably used. Specifically, when the inorganic fine powder is less than about 0.1 weight %, toner aggregation is not sufficiently resolved. However, when it is more than about 2 weight %, toner likely scatters between thin lines and contaminates an inside of a body, and accordingly cuts or damages a photoconductor.

Further, an electric control agent is either adhered to or stuck to a surface of a powder at least made of resin or pigment to shape the surface of the powder to have small and large shape cycles. An optimum average particle diameter of the powder is from about 10 [nm] to about 200 [nm]. Specifically, when the powder is less than about 10 nm, unevenness effective to fluidity is hardly produced. By contrast, when it is more than about 200 nm, the powder particle becomes roughly shaped.

Further, another additives may be added to the toner as far as it does not substantially affects a performance of the toner. Specific additives include power of Teflon™ and zinc stearate powder or the like.

Further, the above described evaluation method can be used to evaluate toner produced by a spray dry method without using a mixing and kneading process or a smashing process or capsule toner.

A resistance of toner is adjusted by including or dispersing conductive material. Specific carbine material includes acetyl black, Oil furnace black, thermal black, carbine fabric, and black lead or the like. Further, specific metal material includes powders of $SnO_2$, ZnO, Cu, Ni or the like. By appropriately dispersing the powder into toner binder resin, the resistance of the toner can be adjusted.

Now, an exemplary magnetic carrier according to one embodiment of the present invention is described. A magnetic carrier is produced by including a spherical particle of ferromagnetic or paramagnetic material made of metal, such as iron, chromium, nickel, cobalt, zinc, copper, etc, and these chemical compound or alloy, such as γ-ferric dioxide, chromium dioxide, oxide Manganese, ferrite, etc. Alternatively, the magnetic carrier is produced by including the above-described magnetic particle covered with resin, such as silicone, styrene, vinyl, ethylene, acrylic, polyamide, polyester, etc., in a spherical state. Further, the magnetic carrier can be produced by including a spherical particle made of resin or fatty acid wax with magnetic fine particles being dispersed therein. Specifically, the thus produced magnetic carrier includes a core material made of resin in which magnetic fine particles are dispersed. Consequently, the magnetic carrier of this embodiment can decrease a specific gravity less than that having a core material of a magnetic particle. As a result, a density of magnetic flux generated by the magnets 407 installed in the developing roller 402 can be decreased, so that control thereof can be easier during developer conveyance.

An exemplary method of producing the magnetic carrier is now described. First, slurry of magnetite is prepared by putting and blending 2-weight part of polyvinyl alcohol and 60-weight part of water with 100-weight part of magnetite, which is produced by a wet process, in a ball mill for 12 hours. Then, 10-part of a low-resistance particle having a total volume resistivity equal to or less than about $10^5$ [Ω·cm] is prepared by including a metal particle, such as iron, SUS, etc., having a diameter of about 80 [nm] covered by a covering layer formed by coating with silicone resin having a volume resistivity equal to or more than about $10^{12}$ [Ω·cm], and is blended in the magnetite slurry. The slurry is then subjected to a spray granulation process using a spray dryer, and a spherical particle having a mean diameter of about 38 [μm] is obtained. The particle is then burned for three hours at temperature of about 1,000 degree centigrade in a nitrogen atmosphere and is cooled down, and a core particle 1 is obtained. The mean diameter is represented by an average of number of pieces.

Exemplary material of the above-described covering layer having a volume resistivity equal or more than about $10^{12}$ [Ω·cm] coated onto a surface of the metal particle includes Polyethylene resins, epoxy resins, Polyester resins (such as modified Polyester resins and unmodified Polyester resins), Polyamide, Polymers of styrene and styrene derivatives, styrene copolymers, vinyl resins, methacrylic resins (e.g., Polymethyl methacrylate, and Polybutyl methacrylate), Polyvinyl chloride, Polyvinyl acetate, polypropylene, epoxypolyol resins, Polyol resins, Phenolic resins, silicone resins, Polyurethane, furan resins, Polyvinyl butyral, acrylic resins (e.g., Polyacrylic acidresins), rosinmodifiedrosin, xylene resins, terpene resins, coumarone-indene resins, Polycarbonate resins, aliPhatic or alicyclic hydrocarbon resins, aromatic petroleum resins, etc.

Since a volume resistivity of such a covering layer coated on the surface of the metal particle ranges from equal or more than about $10^{12}$ [ohm·cm] to equal or less than about $10^{16}$ [ohm·cm], background stein and undesirable carrier attraction to a photoconductive drum may be suppressed. Further, the diameter of the metal particle ranges from equal or more than about 20 [nm] to equal or less than about 100 [nm]. Specifically, when the diameter of the metal particle is less than about 20 [nm], since a magnetized amount decreases per carrier, the carrier is hardly controlled by the magnets.

Subsequently, an exemplary coat layer is produced by mixing the below listed material.

Specifically,

Silicone resin liquid solution: 100 weight part,

Toluene: 100 weight part,

γ-aminopropyl dihydrogen phosphate: 6 weight part, and

Carbon black: 10 weight part.

Figure 3:
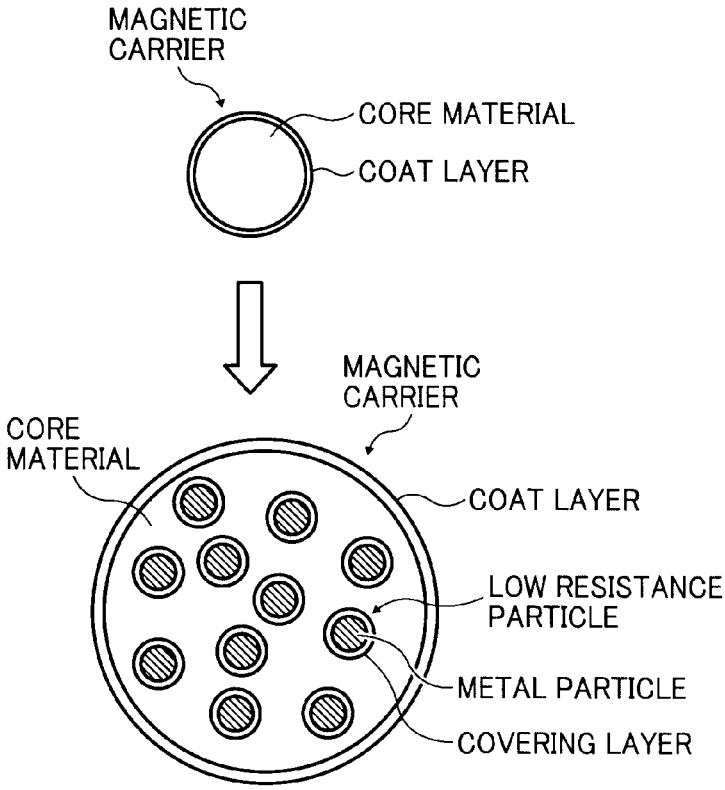
FIG. 3 schematically illustrates an exemplary magnetic carrier.

The above-described mixture is dispersed in a homomixer for twenty minutes, and a coat layer forming liquid is thereby prepared. Subsequently, the coat layer forming liquid is coated onto a surface of the core particle 1 of 1,000 weight part using a fluid bed coating system, and silicone resin coated carrier is obtained as the magnetic carrier of the first embodiment as shown in FIG. 3.

Specifically, the magnetic carrier of the first embodiment includes a magnetite as a magnetic core and a coat layer made of silicone resin overlying thereon. Further, in the magnetite (i.e., the magnetic core), the above-described metal particles made of iron or SUS and the like having the covering layer thereon are dispersed. Such a core can include a spherical particle of ferromagnetic or paramagnetic material made of metal, such as iron, chromium, nickel, cobalt, zinc, copper, etc, and these chemical compound or alloy, such as γ-ferric dioxide, chromium dioxide, oxide Manganese, ferrite, etc.

The magnetic carrier of the first embodiment has characteristics as follows:

Mean particle diameter: 38 [μm] and,

Saturated magnetization: 60 [emu/g].

A volume resistivity and a dielectric constant of the whole magnetic carrier are described later together with a measurement method.

When a volume resistivity of the low-resistance particle having a diameter of about 80 [nm] to be included in the magnetic carrier exceeds $10^5$ [Ω·cm], since a dielectric constant of the particle decreases, a dielectric constant of the total magnetic carrier also decreases. Consequently, a developing ability undesirably deteriorates. The volume resistivity of the low-resistance particle is acceptable if it is more than zero.

Now, an exemplary method of measuring a resistance and a dielectric constant of magnetic carrier is described with reference to FIG. 4. As shown, a magnetic carrier 11 includes a core material made of metal or resin and magnetic material, such as ferrite, etc., with its surface layer being coated with resin or the like. A particle diameter of the magnetic carrier 11 is preferably from about 20 [μm] to about 50 [μm]. Further, a dynamic resistance DR of the magnetic carrier 11 is preferably from about $10^{10}$[Ω] to about $10^{14}$[Ω]. A volume resistivity of the magnetic carrier 11 is preferably equal to or more than about $10^{12}$ [Ω·cm], and is more preferably equal to or more than about $10^{14}$ [Ω·cm]. Specifically, since the volume resistivity of the magnetic carrier 11 is equal to or more than about $10^{14}$ [Ω·cm], leakage rarely occurs even under a high developing potential, and accordingly, an intensive development electric field can be formed. Accordingly a developing performance can be improved. However, the upper limit of the volume resistivity of the magnetic carrier 11 is about $10^{15}$ [Ω·cm].

Figure 4:
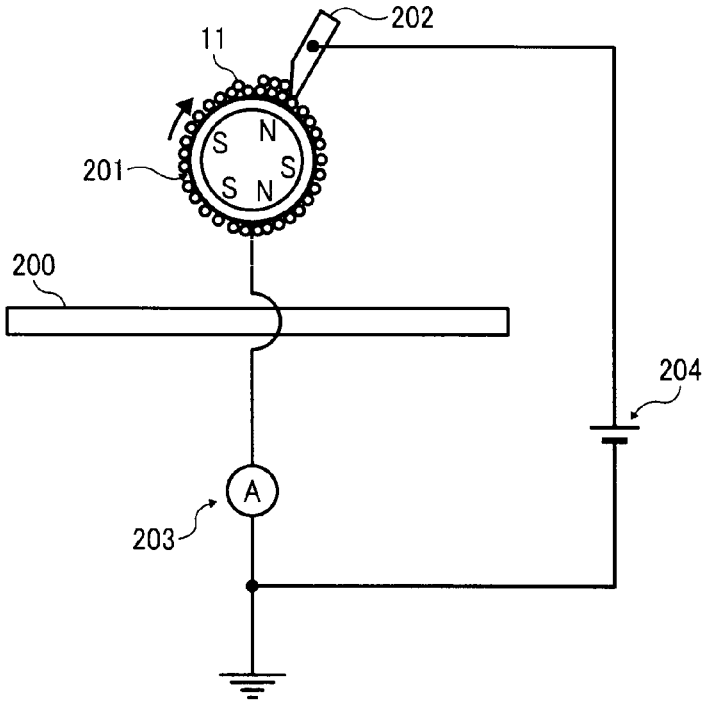
FIG. 4 illustrates an exemplary system and method of measuring a resistance of the magnetic carrier.

Further, the dynamic resistance DR of the magnetic carrier 11 is measured using a measure as shown in FIG. 4 in a manner as described below. First, a rotatable sleeve 201 having a diameter of about 20 [mm] accommodating a fixed magnet at a prescribed position is positioned above a pedestal 200 being grounded. Then, an electrode (i.e., a smoothing blade) 202 having an opposed area having a width (W) of about 65 [mm] and a length (L) of from about 0.5 [mm] to about 1 [mm] is provided being opposed to the surface of the sleeve 201 via a gap (g) of about 0.9 [mm]. Subsequently, the sleeve 201 starts being driven and rotated at a rotation speed of about 600 [rpm (round per minute)] (i.e., a line speed of about 628 [mm/sec]). Then, a prescribed amount (e.g. 14 [g]) of magnetic carrier 11 is borne on the rotating sleeve 201 as a testing object, and is stirred for about ten minutes by rotation of the sleeve 201 as it rotates. Subsequently, an amount of current IRII (A) flowing between the sleeve 201 and the opposed electrode 202 with a current meter 203 without applying a voltage to the sleeve 201. Subsequently, a direct current power source 204 applies an application voltage E (V) of a withstand pressure upper limit level (e.g. more than 400V (when high resistance silicone coat carrier is used), few V (when iron powder carrier is used)) to the sleeve 201 for five minutes. In this embodiment, the application voltage is about 200V. Subsequently, an amount of current IRQ (A) flowing between the sleeve 201 and the opposed electrode 202 is measured with the current meter 203 while applying the application voltage E to the sleeve 201. Based on these measurement results, the dynamic resistance DR [Ω] is calculated using the below-described first formula.

$$DR = E/(IRQ - IRII) \quad \text{(First Formula)}$$

As a result, the dynamic resistance DR [Ω] of the magnetic carrier of the first embodiment is calculated within about $5\times10^{12}$ [Ω].

Such a dynamic resistance DR [Ω] is then converted into a volume resistivity using a prescribed calculation formula with reference to a size of a gap (g) between the surface of the sleeve 201 and the opposed electrode 202 (i.e., the smoothing blade), and equal or more than about $10^{12}$ [Ω·cm] is obtained as the volume resistivity of the magnetic carrier in this embodiment.

Further, a volume resistivity of a low-resistance particle is measured in the same manner as that of the whole magnetic carrier measured by the measure as described with reference to FIG. 4.

Figure 5:
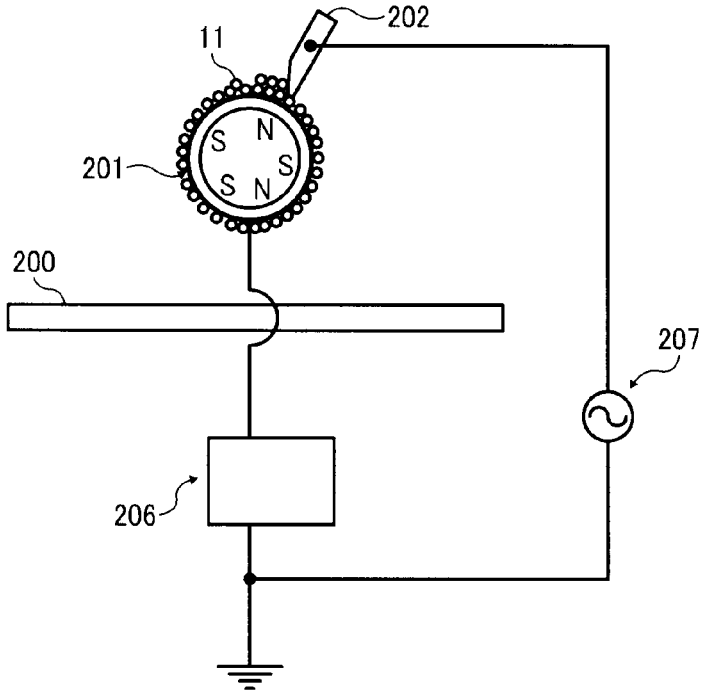
FIG. 5 illustrates an exemplary measuring system and method of measuring a dielectric constant of the magnetic carrier.

Further, a dielectric constant of the magnetic carrier 11 is measured by a measure as shown in FIG. 5. A fundamental configuration of the measure is substantially the same as that measuring the resistance of the magnetic carrier 11 of FIG. 4. However, a dielectric constant measuring instrument 206 is provided instead of the current meter 203 of FIG. 4 to measure a dielectric constant, and an AC power source 207 is employed instead of the DC power source 204 to apply an AC bias to the sleeve 201. Specifically, when a dielectric constant is measured, the sleeve 201 stops being rotated and the AC power source 20 applies an AC bias to the sleeve 201. Subsequently, a dielectric constant of the magnetic carrier 11 sandwiched between the sleeve 201 and the opposed electrode 202 is measured by LCR High Tester 3532 (Serial No. 2001-0340771), manufactured by HIOKI E. E. CORPORATION as dielectric constant measuring instrument 206.

As a result of the measurement, the dielectric constant of the magnetic carrier of the first embodiment is obtained as 17.

Thus, the magnetic carrier of the first embodiment can have a high resistance and a high dielectric constant at the same time. However, an optimum dielectric constant of the magnetic carrier is from about 10 to about 20.

Figure 6:
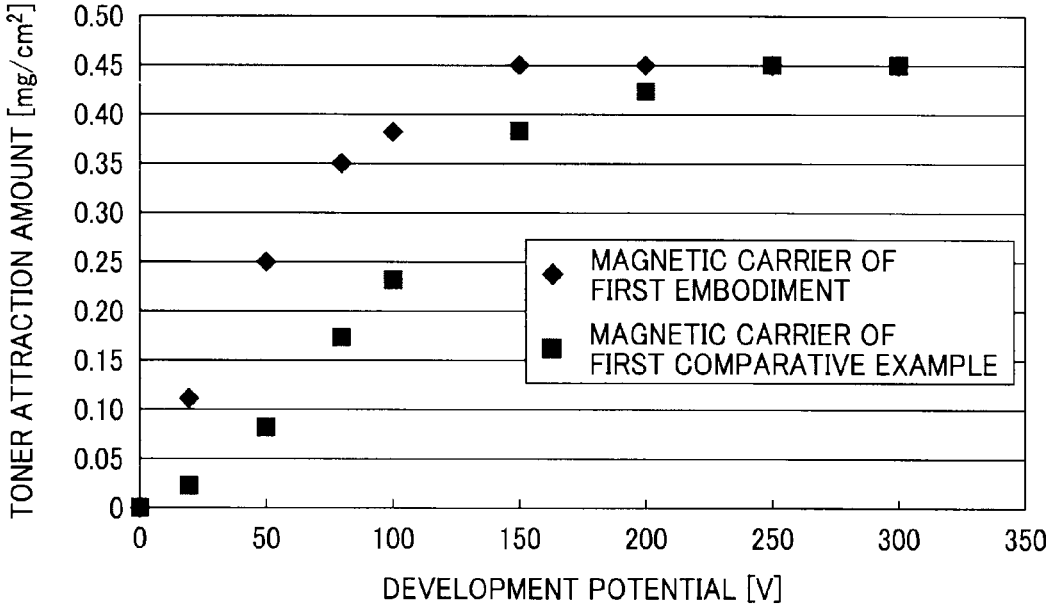
FIG. 6 is a graph illustrating exemplary relations between a toner attraction amount and a developing potential when developer with magnetic carrier of a first embodiment and that with magnetic carrier of a first comparative example are used.

FIG. 6 illustrates exemplary relations between a toner attraction amount and a developing potential obtained when developer with magnetic carrier of a first embodiment and that with magnetic carrier of a first comparative example are used, respectively. The magnetic carrier of a first comparative example is produced by the same manner as the magnetic carrier of a first embodiment is produced except that a core particle of the magnetic carrier of a first comparative example is produced without blending a metal particle. In the above, magnetic carrier having a voltage resistance equal or more than about $10^{14}$ [Ω·cm] and a dielectric constant of about 3 is used for that of the first comparative example. The below-described table represents voltage resistivities and dielectric constants of the magnetic carriers of the first embodiment and the first comparative example.

First Table:

| Magnetic carrier | Volume resistivity | Dielectric Constant |
|---|---|---|
| First Embodiment | Not less than $10^{12}$ [Ω · cm] | 17 |
| First comparative Example | Not less than $10^{14}$ [Ω · cm] | 3 |

Since a dielectric constant of the magnetic carrier of the developer of the first embodiment is higher than that of the first comparative example, an edge effect caused by the dielectric constant of the magnetic carrier can be more suppressed (see a toner attraction amount in FIG. 6) and a developing performance is improved in the first embodiment than in the first comparative example. Consequently, a high quality image is acquired including when an image of a dot having a small diameter is developed. Since the volume resistivity of the magnetic carrier of each of the first embodiment and the first comparative example is sufficiently high to be able to suppress carrier attraction, an adverse affect to image quality can be reduced.

Now, exemplary advantageous alternation of a direction of the AC electric field to obtain a high quality image is described. When a width of a nip between a photoconductor 1 and a developing roller 402 and a line speed of the photoconductor are represented by N and Vp, respectively, a contact time when the surface of the photoconductor 1 contacts a developer layer borne on the developing roller 402 and completes development with developer thereof in the developing region A1 is represented as N/vP. A rate of one cycle of an AC bias changing at a frequency "f" to the above described contact time represents an alternating number of times when a direction of the AC electric field is changed as sought by a below-described second formula.

$$\text{Number of AC electric field alternating times} = f \times (N/vP) \quad \text{(Second Formula)}$$

Form the past investigation, an optimum frequency of the AC bias (e.g. having a rectangular wave) in relation to a rotation line speed of the photoconductor 1 has been already known as listed in the below-described second table.

Second Table:

| Line Speed of Photoconductor (mm/s) | Frequency of AC Bias (kHz) |
|---|---|
| 700 | 11 |
| 400 | 8 |
| 200 | 4 |

Figure 7:
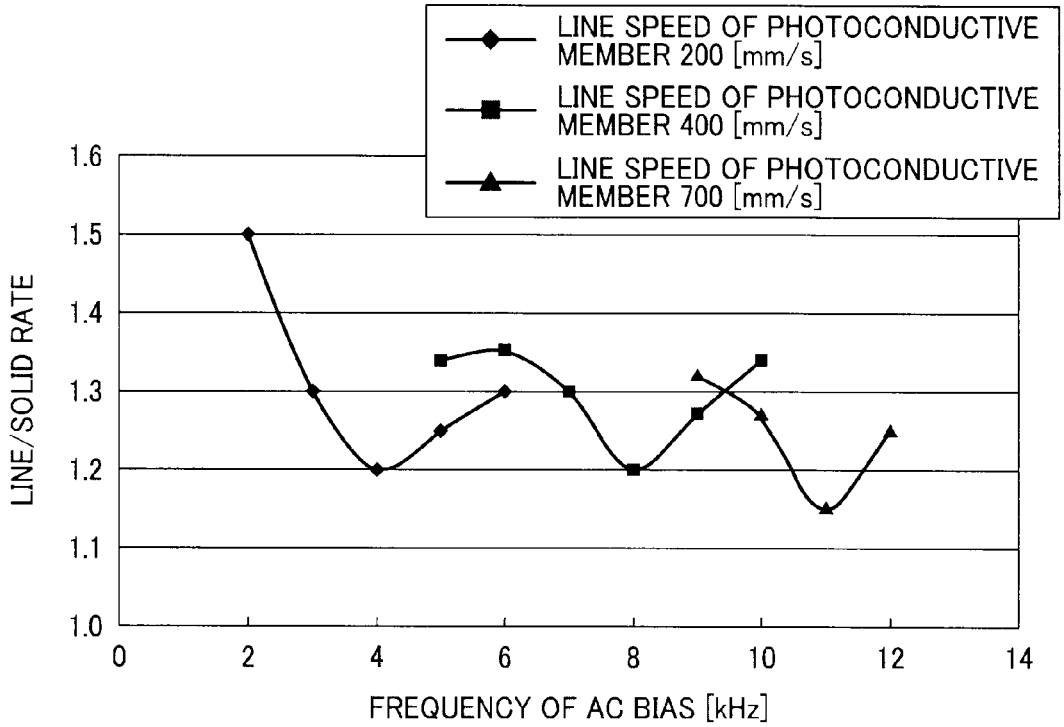
FIG. 7 is a graph showing exemplary comparison of optimum points of an AC bias frequency per line speed of a photoconductor.
Figure 8:
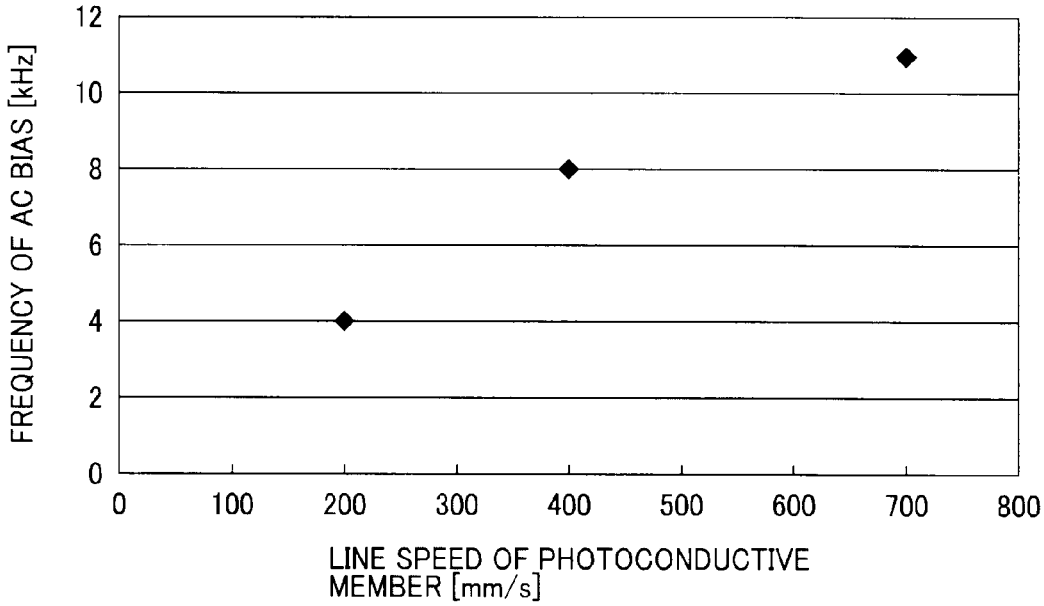
FIG. 8 is a graph showing an exemplary relation between an optimum AC bias frequency and a line speed of a photoconductor.

FIG. 7 shows an exemplary comparison of an optimum point of a frequency of the AC bias per line speed of the photoconductor 1, in which a vertical axis represents a toner attraction performance represented by a rate of an amount of toner attracted to a line image to that attracted to a solid image under a prescribed potential. In general, the line image is included more than the solid image in an image, and image quality is favorable when the rate approaches to one. As a result of the comparison, it is recognized that a prescribed optimum condition can be obtained in accordance with the line speed of the photoconductor 1 at a prescribed frequency as shown in FIG. 8, in which a relation between the frequency of the AC bias and the line speed of the photoconductor 1 is illustrated.

Further, since an adhesion force of toner to the carrier can be reduced in accordance with the number of alternating times of the AC electric field, development can be improved. It is also understood that an adhesion condition of the toner to a latent image is refined due to its reciprocation between the developing roller 402 and the photoconductor 1 in accordance with the alternation of the AC electric field. Accordingly, determination of a prescribed number of alternating times is essential to obtain a high quality image.

In this embodiment, when the second formula is calculated based on the relation between the optimum AC bias frequency and the line speed of the photoconductor 1 as shown in the second table, since a nip width N in a photoconductor rotation direction at a developing nip formed between the photoconductor 1 and the developing roller 402 is about 4 [mm], a necessary times of alternating the AC electric field is eighty when the line speed of the photoconductor is 200 [mm/s] or 400 [mm/s], and sixty three when it is 700 [mm/s].

As a specific performance, a developing gamma performance of the line latent image is substantially the same as that of the solid latent image, and a fine quality image can be obtained. Accordingly, since the above-described performance is improved by the numbers of alternating times equal or more than sixty-three, a relation as shown in a below-described third formula can be presented.

$$f \geqq 63 \times (vP/N) \quad \text{(Third Formula)}$$

Further, even when the first and second step developments are executed as different from this embodiment, the respective development performances may be effective, because a relation between the line speed of the photoconductor and an optimum frequency of the AC bias is constant.

Now, a second exemplary embodiment is described, in which a developing gap changer is additionally provided to the various devices of the first embodiment to oscillate a developing roller 402 to change a developing gap.

Developer is borne on the developing roller 402 by a magnetic force and a friction coefficient of the surface of the developing roller 402, and is conveyed as the developing roller 402 rotates.

In the second embodiment, by oscillating the developing roller 402 to approach the photoconductor 1 and thereby increasing an intensity of the electric field of development, development performance is improved as described below in detail.

Figure 9:
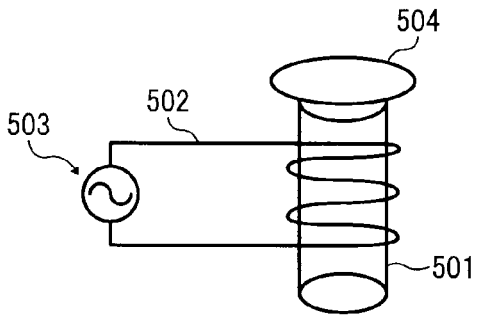
FIG. 9 schematically illustrates an exemplary configuration of a developing gap changer according to another embodiment of the present invention.

Specifically, as shown in FIG. 9, an electromagnet is provided in the developing gap changer by winding a coil 502 connected to the AC power source 503 around a bar state ferrite material 501 to enable the bar state ferrite material 501 to move in its axis direction within the coil 502. One end of the ferrite material 501 is connected to a wall 504 of the casing 401 of the developing device 4. Then, by applying an AC bias from the AC power source 503 to the coil 502, a direction of a magnetic field generated in the coil 502 is periodically changed to reciprocate the ferrite material 501 in its axis direction in accordance with the periodic change, so that the casing 401 of the developing device 4 can be oscillated. Hence, when the casing 401 of the developing device 4 oscillated, the developing roller 402, a rotation shaft of which is supported by a supporting section of the casing 401, is accordingly oscillated.

By oscillating the developing roller 402 in this way while making the developing gap of at most 300 [μm], a distance between the photoconductor 1 and the developing roller 402 is timely changed.

The oscillation system is not limited to the above-described device, and can include a system that applies a voltage to a piezo material to obtain the oscillation as far as an amplitude and a frequency are controlled within a prescribed necessary range.

Figure 10:
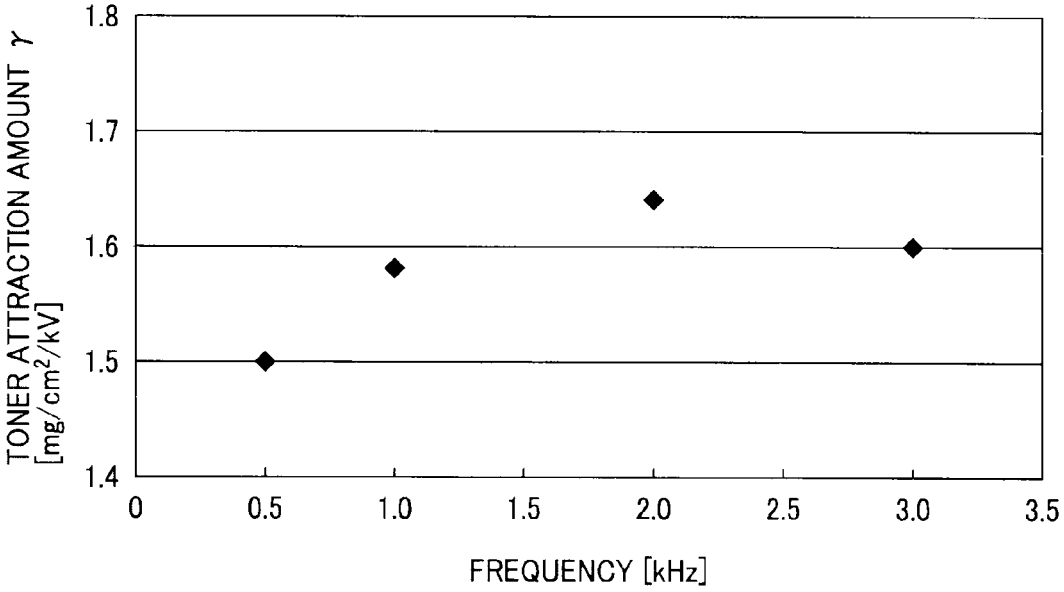
FIG. 10 is a graph showing an exemplary change in a toner attraction amount in accordance with a oscillation frequency of the developing gap.

FIG. 10 illustrates an exemplary change in a toner attraction amount in accordance with an oscillation frequency of the developing casing when a developing potential is 1.64 [mg/cm$^2$/kV]. It is understood therefrom that when the developing gap is changed in a prescribed cycle in the second embodiment, the developing amount more increases at the frequency 2 [kHz] than at the other frequencies even if the developing potential is the same to be 1.64 [mg/cm$^2$/kV] as shown in FIG. 10. Further, when the developing roller 402 is oscillated to change the developing gap from 300 [μm] to 150 [μm] vice-versa with their average being 225 [μm], an inclination of the developing performance of gamma increases as a whole.

Since a resistance of the magnetic carrier is equal or more than $10^{12}$ [Ω·cm], and a dielectric constant is high due to inclusion of multiple low-resistance particles in the magnetic carrier also in this embodiment, the edge effect can be suppressed in the developing region A1. Further, since a resistance of the carrier is sufficiently high, adhesion of the carrier to the photoconductor 1, generally caused by electric charge injection into the magnetic carrier, can be suppressed while appropriately maintaining an electric field formation range, in which various conditions can be readily designated.

Now, a third embodiment of the present invention is described. Magnetic carrier of this embodiment is produced by dispersing magnetic fine particles in a core material made of resin, and has a dielectric constant of about 17 and a volume resistivity of about $10^{14}$ [Ω·cm]. Further, as a magnetic carrier of a second comparative example, magnetic carrier having a dielectric constant of about 4 and a volume resistivity of about $10^{10}$ [Ω·cm] are prepared. Then, performances of the magnetic carriers of the third embodiment and the second comparative example are evaluated.

Initially, an exemplary method of producing the third magnetic carrier is described.

A mixture is prepared by including the below-described material;

Acrylic acid resin liquid solution: 21.0 part (HITALOYD 2450, Solid part 50 weight %, produced by Hitachi Chemical Co., Ltd.), Guanamine liquid solution (Solid part 70 weight %): 6.4 part Alumina particle (0.3 [μm], resistivity of about $10^{14}$ [Ω·cm]: 120 part Toluene: 665 part, and Butyl cellosolve: 665 part.

The Mixture of the above-described material is dispersed in a homomixer for ten minutes, and Acrylic acid resin liquid solution is obtained.

Subsequently another mixture is prepared by including the below-described material;

Silicon resin liquid solution: 63.9 part (Solid part 23 weight %, SR 2400, produced by Toray Dow Corning Silicon Co., Ltd.), and Aminosilane: 0.3 part (Solid part 100 weight %, SH 6020, produced by Toray Dow Corning Silicon Co., Ltd.).

The other mixture of the above-described material is dispersed in a vessel using an agitator for five minutes, and Silicon liquid solution is obtained. The Silicon liquid solution and Carbon black (Black Peris 2000, manufactured by CABOT CORPORATION) of 4.6 part are put into a homomixer storing the Acrylic acid resin liquid solution and are dispersed for ten minutes. Consequently, a coat film producing liquid solution is produced including carbon black dispersed over a coat resin, and is coated and dried by a Spira coater manufactured by OKADA SEIKO CO., LTD to have a film thickness of about 0.15 [μm].

The thus obtained carrier is left and is burned in an electric heating furnace at temperature of about 150 degree centigrade for one hour. After, cooling the thus burned carrier, ferrite powder bulk is smashed by a sieve having a mesh size of about 106 [μm] to obtain carrier.

Figure 11:
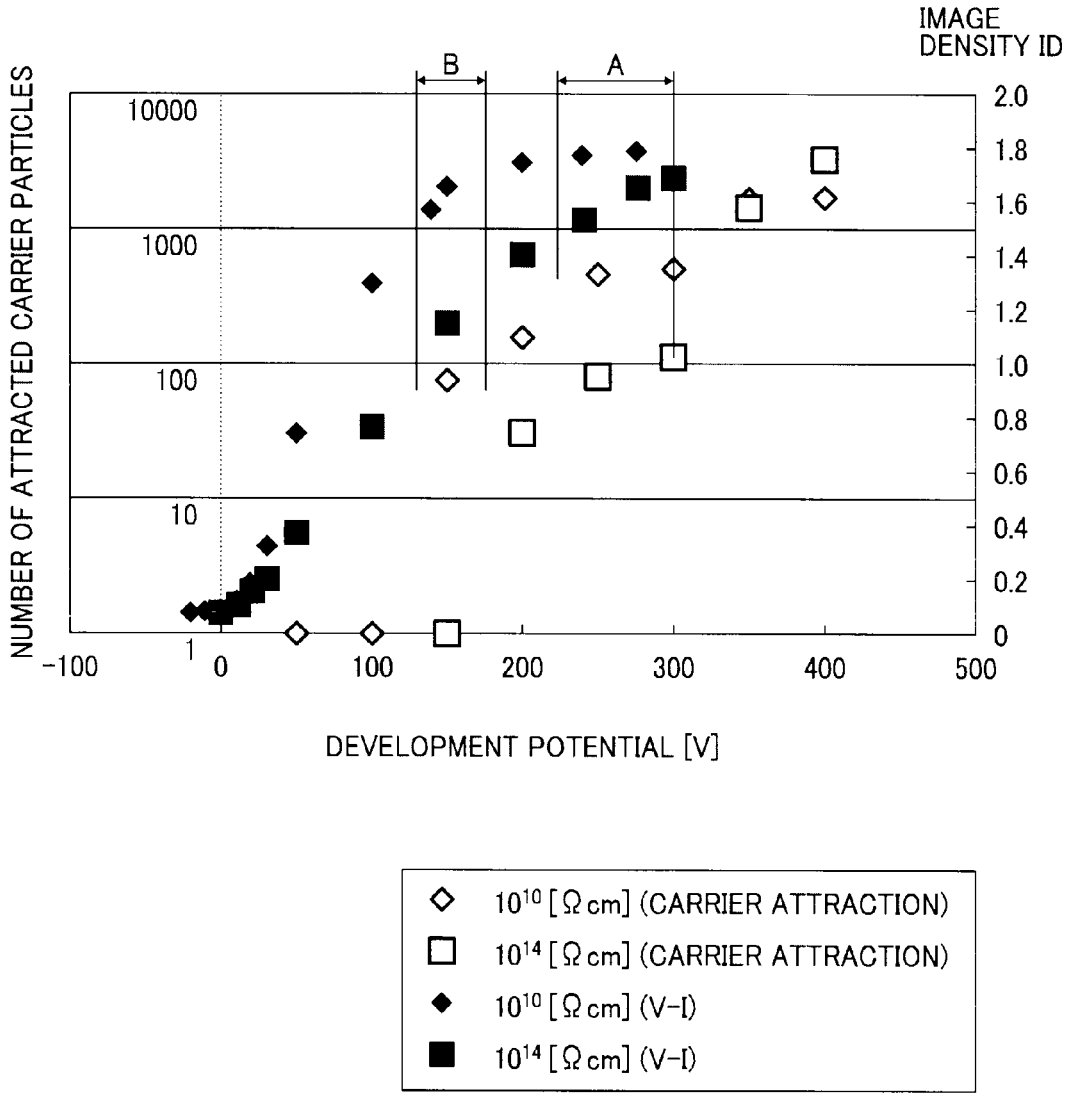
FIG. 11 is a graph showing a range in which a prescribed image density is acquired while suppressing adhesion of carrier per volume resistivity of magnetic carrier.

Now, a range, in which a prescribed image density is obtained while suppressing carrier attraction at the same time when developer including magnetic carrier of the third embodiment and that of the second comparative example are put into a developing device 4 of a printer of FIG. 1 and image formation is executed, is described with reference to FIG. 11. Components other than the magnetic carrier in the developer of the third embodiment and the second comparative example are the same.

As shown, an outline quadrangle represents a carrier attraction amount when developer including the magnetic carrier of the third embodiment is used. An outline rhombus represents a carrier attraction amount when developer including the magnetic carrier of the second comparative example is used. Further, a solid quadrangle represents image density when developer including the magnetic carrier of the third embodiment is used. A solid rhombus represents image density when developer including the magnetic carrier of the second comparative example is used. In the drawing, the compatible range enabling to obtain the prescribed image density while suppressing the carrier attraction amount is represented by "A" when developer including the magnetic carrier of the third embodiment is used. Whereas the compatible range is represented by "B" when developer including the magnetic carrier of the second comparative example is used.

Such a compatible range is specified by a developing potential having image density ID of equal or more than 1.5 and a carrier attraction amount of less than 100 (items/A3 size (JIS)) as a width.

As understood therefrom, when the developer including the magnetic carrier of the second comparative example having a dielectric constant of about 4 and a volume resistivity of about $10^{10}$ [Ω·cm] is used, a practically usable developing potential width and preferable image formation condition, changed as time elapses and in accordance with environment, becomes narrower than that when the developer including the magnetic carrier of the third embodiment having a dielectric constant of about 17 and a volume resistivity of about $10^{14}$ [Ω·cm] is used. Whereas, when the developer including the magnetic carrier of the third embodiment is used, since the practically usable developing potential width becomes wider than that when the developer including the magnetic carrier of the second comparative example is used, designation of an image formation condition becomes flexible even as time elapses and environment changes.

Specifically, since a usable developing potential width increases when the magnetic carrier has relatively high dielectric constant and volume resistivity, an adjustment width of digital gamma performance including that of a light intensity increases for example, so that image formation is more appropriately executed.

According to one embodiment of the present invention, adverse effect of a carrier attraction amount or the like to image quality is decreased. Further, since developing performance is improved, quality of an image including a latent image having dots of a small diameter can be obtained. Because, a novel image forming apparatus comprises an image bearer to bear a latent image on its surface, a developer container to accommodate developer composed of toner and magnetic carrier, and a developing device. The developing device includes a non-magnetic rotatable sleeve as a developer bearer to bear the developer on its surface, and a development electric field generator to generate a development electric field between the image bearer and the developer bearer by applying a development bias to the developer bearer. The developing device visualizes the latent image borne on the image bearer as a toner image with the toner of the developer in the development electric field. The developing bias is an AC bias that generates an AC electric field therebetween. The magnetic carrier includes a plurality of fine particles each covered by a covering layer made of prescribed material having a volume resistivity equal to or more than $10^{12}$ [Ω·cm] and having a prescribed particle diameter equal to or less than 100 [nm]. Each of the a plurality of fine particles has a total volume resistivity equal to or less than $10^{5}$ [Ω·cm]. The magnetic carrier has a total volume resistivity equal to or more than $10^{12}$ [Ω·cm]

According to another embodiment, a relative density of the magnetic carrier thereof is smaller than that having a center core material of a magnetic particle in a magnetic carrier. Accordingly, density of magnetic flux of the magnets 407 arranged in the developing roller 402 as a developer bearer may be decreased, so that conveyance thereof can be easily controlled. Because, the carrier is produced by dispersing magnetic fine particles into prescribed resin. Because, the magnetic carrier is produced by dispersing the magnetic fine particles into resin.

According to yet another embodiment, since a number of reciprocating times of toner in the developing region A1 between the photoconductor 1 and the developing roller 402 is controlled to be a prescribed level in accordance with a line speed of the photoconductor, developing performance can be maintained. Because, the AC electric field is alternated more than Prescribed reference times by changing frequency of the AC bias in accordance with a line speed of the image bearer, and because, a direction of the AC electric field is alternated more than prescribed number of times in a prescribed time period (during a development process) by changing a frequency of the AC bias in accordance with a line speed of the image bearer.

According to yet another embodiment, since toner sufficiently reciprocate due to the AC electric field, toner attraction to a latent image of the photoconductor is refined, quality of an image is improved. Because, a below-described relation is met, $$f \geq 63 \times vP/N,$$

wherein f represents frequency [kHz] of an AC bias, vP represents a line speed [mm/s] of an image bearer, and N represents a width [mm] of a developing nip (in an image bearer rotating direction) formed between the image bearer and the developing bearer.

According to yet another embodiment, since the developing roller 402 is enabled to approach the photoconductor 1, an intensity of development electric field is increased, and accordingly developing performance is improved. Because, a developing gap creator is provided to create a developing gap between the image bearer and the developing, and a gap adjuster to change the gap in a prescribed cycle. Because, a developing gap creator is provided to create a developing gap between the image bearer and the developer bearer, and a gap changer to change a size of the gap in a prescribed cycle.

According to yet another embodiment, since leakage rarely occurs while forming a strong development electric field even in the relatively high potential, developing performance is accordingly improved. Because, a total volume resistivity of the magnetic carrier is equal to or more than $10^{14}$ [Ω·cm]. Because, the total resistivity of the magnetic carrier is equal to or more than $10^{14}$ [Ω·cm].

Numerous additional modifications and variations of the Present invention are Possible in light of the above teachings. It is therefore to be understood that within the scope of the appended claims, the Present invention may be Practiced otherwise than as specifically described herein.

What is claimed is:

1. An image forming apparatus for forming an image, comprising:

an image bearer to bear a latent image on its surface;

a developer container to accommodate developer, said developer having toner and magnetic carrier; and a developing device includes:

a non-magnetic rotatable sleeve as a developer bearer to bear the developer on its surface; and a development electric field generator to generate a development electric field between the image bearer and the developer bearer by applying a development bias to the developer bearer, said developing device visualizing the latent image borne on the image bearer as a toner image with the toner of the developer in the development electric field, wherein said development bias is an AC bias that generates an AC electric field therebetween as the development electric field, wherein said magnetic carrier includes a plurality of fine particles each covered by a covering layer made of prescribed material having a volume resistivity equal to or more than $10^{12}$ [Ω·cm] and having a prescribed particle diameter equal to or less than 100 [mm], each of said a plurality of fine particles having a total volume resistivity equal to or less than $10^{5}$ [Ω·cm], said magnetic carrier having a total volume resistivity equal to or more than $10^{12}$ [Ω·cm], wherein a direction of said AC electric field is alternated a prescribed number of times or more per unit of time during a development process by changing a frequency of said AC bias in accordance with a line speed [mm/s] of the image bearer.

2. The image forming apparatus as claimed in claim 1, wherein the magnetic fine particles are dispersed in resin.

3. The image forming apparatus as claimed in claim 1, wherein the total resistivity of said magnetic carrier is equal to or more than $10^{14}$ [Ω·cm].

4. An image forming apparatus for forming an image, comprising:

an image bearer to bear a latent image on its surface;

a developer container to accommodate developer, said developer having toner and magnetic carrier;

a developing device includes:

a non-magnetic rotatable sleeve as a developer bearer to bear the developer on its surface; and a development electric field generator to generate a development electric field between the image bearer and the developer bearer by applying a development bias to the developer bearer, said developing device visualizing the latent image borne on the image bearer as a toner image with the toner of the developer in the development electric field, wherein said development bias is an AC bias that generates an AC electric field therebetween as the development electric field, wherein said magnetic carrier includes a plurality of fine particles each covered by a covering layer made of prescribed material having a volume resistivity equal to or more than $10^{12}$ [Ω·cm] and having a prescribed particle diameter equal to or less than 100 [mm], each of said a plurality of fine particles having a total volume resistivity equal to or less than $10^{5}$ [Ω·cm], said magnetic carrier having a total volume resistivity equal to or more than $10^{12}$ [Ω·cm]; and a gap changer to change a size of agap formed between the image bearer and the developer bearer in a prescribed cycle.

5. The image forming apparatus as claimed in claim 4, wherein the magnetic fine particles are dispersed in resin.

6. The image forming apparatus as claimed in claim 4, wherein the total resistivity of said magnetic carrier is equal to or more than $10^{14}$ [Ω·cm].

7. A method of forming an image comprising the steps of:

bearing a latent image on an image bearer;

bearing developer composed of toner and magnetic carrier, said magnetic carrier including a plurality of fine particles each covered by a covering layer made of prescribed material having a volume resistivity equal to or more than $10^{12}$ [Ω·cm], each of said a plurality of fine particles having a prescribed diameter equal to or less than 100 [mm] and having a total volume resistivity equal to or less than $10^{5}$ [Ω·cm], said magnetic carrier having a total volume resistivity equal to or more than $10^{12}$ [Ω·cm];

approximating the developer of the developer bearer to the image bearer bearing the latent image;

providing an AC development bias to the developer bearer (with a development electric field generator);

generating an AC development electric field between the image bearer and the developer bearer;

developing the latent image with the developer by adhering the developer to the latent image under the AC development bias; and alternating a direction of said AC development electric field a prescribed number of times or more per unit time by changing a frequency of said AC development bias in a development process in accordance with a line speed of the image bearer.

8. The method as claimed in claim 7, wherein the magnetic fine particles are dispersed in prescribed resin.

9. The method as claimed in claim 7, wherein a total volume resistivity of said magnetic carrier is equal to or more than $10^{14}$ [Ω·cm].

10. A method of forming an image comprising the steps of:

bearing a latent image on an image bearer;

bearing developer composed of toner and magnetic carrier, said magnetic carrier including a plurality of fine particles each covered by a covering layer made of prescribed material having a volume resistivity equal to or more than $10^{12}$ [Ω·cm], each of said a plurality of fine particles having a prescribed diameter equal to or less than 100 [mm] and having a total volume resistivity equal to or less than $10^{5}$ [Ω·cm], said magnetic carrier having a total volume resistivity equal to or more than $10^{12}$ [Ω·cm];

approximating the developer of the developer bearer to the image bearer bearing the latent image;

providing an AC development bias to the developer bearer (with a development electric field generator);

generating an AC development electric field between the image bearer and the developer bearer; and developing the latent image with the developer by adhering the developer to the latent image under the AC development bias, creating a developing gap between the image bearer and the developer bearer; and changing a size of the gap in a prescribed cycle.

11. The method as claimed in claim 10, wherein the magnetic fine particles are dispersed in prescribed resin.

12. The method as claimed in claim 10, wherein a total volume resistivity of said magnetic carrier is equal to or more than $10^{14}$ [Ω·cm].

* * * * *